US008328965B2

(12) United States Patent
Bronzato et al.

(10) Patent No.: US 8,328,965 B2
(45) Date of Patent: Dec. 11, 2012

(54) METHOD FOR MANUFACTURING SPHEROIDAL CAST IRON MECHANICAL COMPONENTS

(75) Inventors: Maurizio Bronzato, Minerbe (IT); Zeljko Ilibasic, Minerbe (IT); Franco Zanardi, Minerbe (IT)

(73) Assignee: Zanardi Fonderie S.p.A., Minerbe (IT)

( * ) Notice: Subject to any disclaimer, the term of this patent is extended or adjusted under 35 U.S.C. 154(b) by 386 days.

(21) Appl. No.: 12/307,237

(22) PCT Filed: Jun. 18, 2007

(86) PCT No.: PCT/EP2007/005333

§ 371 (c)(1),
(2), (4) Date: Dec. 31, 2008

(87) PCT Pub. No.: WO2008/003395

PCT Pub. Date: Jan. 10, 2008

(65) Prior Publication Data

US 2009/0320971 A1 Dec. 31, 2009

(30) Foreign Application Priority Data

Jul. 3, 2006 (IT) ..... 2006A0111

(51) Int. Cl.
*C21D 5/00* (2006.01)
*C22C 37/00* (2006.01)

(52) U.S. Cl. ..... 148/612; 148/321

(58) Field of Classification Search ..... 148/321, 148/612

See application file for complete search history.

(56) References Cited

U.S. PATENT DOCUMENTS

| | | | |
|---|---|---|---|
| 3,891,432 | A | 6/1975 | Nakae et al. |
| 4,396,442 | A | 8/1983 | Nakamura et al. |
| 4,541,878 | A | 9/1985 | Muehlberger et al. |
| 5,603,784 | A | 2/1997 | Bay |
| 5,858,127 | A | 1/1999 | Ott et al. |
| 5,876,523 | A | 3/1999 | Nagayoshi et al. |
| 2004/0112479 | A1 | 6/2004 | Druschitz et al. |

FOREIGN PATENT DOCUMENTS

| | | | |
|---|---|---|---|
| CN | 1232882 | A | 10/1999 |
| CN | 2549226 | Y | 5/2003 |
| JP | 57019320 | A * | 2/1982 |

* cited by examiner

*Primary Examiner* — Kiley Stoner
*Assistant Examiner* — Alexander Polyansky
(74) *Attorney, Agent, or Firm* — Scully, Scott, Murphy & Presser, P.C.

(57) ABSTRACT

A method for manufacturing mechanical components made of spheroidal cast iron, comprising the following steps: —providing a casting of a mechanical component made of cast iron having a structure which is at least partially ferritic and has a carbon content ranging from 2.5% to 4.0% and a silicon content ranging from 2.0% to 3.5%; —bringing the cast iron casting having an at least partially ferritic structure to a temperature for partial austenitizing which is higher than the lower limit austenitizing temperature (Ac1) and lower than the upper limit austenitizing temperature (Ac3) for a time required to obtain an at least partially austenitic structure; —performing a thermal treatment for isothermal hardening at a temperature ranging from 250° C. to 400° C. in order to obtain a matrix which has at least partially a pearlitic-ferritic or perferritic structure.

12 Claims, 4 Drawing Sheets

200x micrograph, region with modulus 2.7 supporting bracket 200x micrograph, region with modulus 2.7 supporting bracket 200x micrograph, region with modulus 1.3, supporting bracket 200x micrograph, spider holder region with modulus 2.4

200x micrograph, spider holder region with modulus 1.35

200x micrograph, spider holder region with modulus 1.2

METHOD FOR MANUFACTURING SPHEROIDAL CAST IRON MECHANICAL COMPONENTS

TECHNICAL FIELD

The present invention relates to a method for manufacturing spheroidal cast iron mechanical components.

BACKGROUND ART

Spheroidal cast irons of different types and having different structures are currently known and used particularly to provide different types of mechanical components.

Spheroidal cast iron has, as its main characteristic, the shape of the graphite, which is indeed spheroidal, differently from what occurs in conventional gray cast irons with lamellar graphite; the spheroidal structure of the graphite gives the material high ductility.

Spheroidal cast irons subjected to a thermal treatment for normalization have a completely pearlitic matrix. In this case, the material is characterized by a higher wear resistance, although ductility is quite reduced and fatigue strength does not increase due to the thermal treatment. Indeed, with reference to the ISO 1083 standard, pearlitic spheroidal cast iron without thermal treatment, classified by the code JS/800-2/S, has a minimum HBW hardness of 245, a minimum tensile strength of 800 MPa, and a typical fatigue strength of 304 MPa.

Pearlitic spheroidal cast iron subjected instead to a thermal treatment for normalization has a minimum HBW hardness of 270, a minimum tensile strength of 900 MPa, and a typical fatigue strength which is unchanged, i.e., equal to 304 MPa.

Spheroidal cast irons subjected to thermal treatment for hardening in water or oil have a bainitic or martensitic structure. They can optionally be subjected, at the end of the cooling process, to a thermal tempering treatment. Such cast irons are generally characterized by a very low ductility accompanied by high surface hardness and consequently are not used in applications which require a certain fatigue strength.

From what has been described above briefly, it can be seen that if a pearlitic spheroidal cast iron is subjected to a thermal treatment in a classic manner, an increase in fatigue strength is not observed.

In order to try to devise a material which would have improved mechanical strength characteristics and especially improved fatigue strength characteristics, the austempered spheroidal cast iron known commercially as ADI (Austempered Ductile Iron) has been devised.

The thermal treatment required to obtain this type of cast iron consists of a complete austenitizing treatment, keeping the component at a temperature which is higher than the upper limit austenitizing temperature (commonly referenced as $A_{c3}$), followed by hardening in a bath of molten salts.

The final structure thus obtained, technically known as ausferritic structure, is composed of acicular ferrite and austenite. This particular structure gives the material high mechanical characteristics and most of all a superior fatigue strength, with lower machinability than traditional spheroidal cast irons.

Since it is essential to avoid the forming of pearlite during cooling, it is necessary to alloy the material with alloying elements such as nickel and/or molybdenum.

In the mid-1980s, the company applying for the present patent developed, under license from Dr. Horst Muehlberger, a particular thermal treatment which allowed to obtain an austempered cast iron known as GGG 70 B/A: this thermal treatment consists of austenitizing at a temperature lower than $A_{c3}$ (the upper austenitizing limit temperature) and higher than $A_{c1}$ (lower austenitizing limit temperature), followed by hardening in a bath of molten salts.

The resulting final structure, technically known as ausferritic structure with proeutectoid ferrite, is composed of proeutectoid ferrite, acicular ferrite and austenite. Since it is essential to prevent the formation of pearlite during cooling, and since the austenitizing temperature used during the first step of the thermal treatment is also relatively low, in this case also it is necessary to alloy the material with alloying elements such as nickel and/or molybdenum in percentages which are higher than in austempered spheroidal cast irons, which as explained earlier have no proeutectoid ferrite.

This particular type of cast iron has been introduced, in the ISO 17804 standard, with the designation JS/800-10 and more recently in SAE standard J2477 May 2004 revision, with the designation AD750. The fatigue strength of this particular type of cast iron is typically equal to 375 MPa.

Recently, spheroidal cast irons known commercially by the acronym MADI (Machinable Austempered Ductile Iron) have also been proposed; this type of cast iron also is obtained as a consequence of a thermal treatment for partial austenitizing at a temperature which is lower than $A_{c3}$ and higher than $A_{c1}$ and subsequent hardening in a bath of molten salts. The resulting final structure is different from the structure of the type classified as GGG70 B/A and/or ISO 17804/JS/800-10 and/or SAE J2477 AD750 due to the presence of finally dispersed martensitic needles. However, even MADI cast irons are characterized by the high content of alloying materials such as nickel and molybdenum.

ADI or MADI cast irons ultimately have definitely higher static mechanical characteristics and fatigue limits, but since they are obtained by hardening in salt, as mentioned, they require alloying materials such as nickel and molybdenum in order to ensure their hardenability without the risk of forming pearlite. Currently, therefore, due to the high cost of such alloying elements, these materials, despite being valid in terms of mechanical characteristics, are scarcely competitive on an economical level.

DISCLOSURE OF THE INVENTION

The aim of the present invention is to provide a new method for the production of spheroidal cast iron which allows to obtain a material which has higher mechanical characteristics than traditional spheroidal cast irons (ferritic, pearlitic, ferritic-pearlitic, et cetera) but has a significantly lower production cost than austempered cast irons (ADI and MADI).

This aim and these and other objects, which will become better apparent hereinafter, are achieved by a method for manufacturing mechanical components made of spheroidal cast iron, characterized in that it comprises the following steps:

- providing a casting of a mechanical component made of cast iron having a structure which is at least partially ferritic and has a carbon content ranging from 2.5% to 4.0% and a silicon content ranging from 2.0% to 3.5%;
- bringing said cast iron casting having an at least partially ferritic structure to a temperature for partial austenitizing, which is higher than the lower limit austenitizing temperature ($A_{c1}$) and lower than the upper limit austenitizing temperature ($A_{c3}$) for a time required to obtain an at least partially austenitic structure;
- performing a thermal treatment for isothermal hardening at a temperature ranging from 250° C. to 400° C. in order to obtain a matrix which has at least partially a pearlitic-ferritic or perferritic structure.

BRIEF DESCRIPTION OF THE DRAWINGS

Further characteristics and advantages of the invention will become better apparent from the description of some preferred but not exclusive embodiments of a method for manufacturing spheroidal cast iron according to the present invention, illustrated by way of non-limiting example in the accompanying drawings, wherein.

In the examplary embodiments that follow, individual characteristics, given in relation to specific examples, may actually be interchanged with other different characteristics that exist in other examplary embodiments.

Moreover, it is noted that anything found to be already known during the patenting process is understood not to be claimed and to be the subject of a disclaimer.

WAYS OF CARRYING OUT THE INVENTION

With reference to the figures, the present invention relates to a method for manufacturing mechanical components made of spheroidal cast iron, such as for example supports, spiders, hubs and mechanical components in general.

In particular, the method provides for the following steps:

providing a casting of a mechanical component made of cast iron having a structure which is at least partially ferritic and has a carbon content ranging from 2.5% to 4.0% and a silicon content ranging from 2.0% to 3.5%;

bringing the cast iron casting having an at least partially ferritic structure to a temperature which is higher than the lower austenitizing temperature ($A_{c1}$) and lower than the upper austenitizing temperature ($A_{c3}$) for a time required to obtain an at least partially austenitic structure;

performing a thermal treatment for isothermal hardening at a temperature ranging from 250° C. to 400° C. in order to obtain a matrix which has a substantially pearlitic-ferritic or perferritic structure.

In particular, it has been found that it is particularly convenient for the percentage of ferrite in the casting on which the thermal treatment is to be performed to be higher than 20%, preferably higher than 50%.

Experimentally, moreover, it has been found that it is particularly advantageous in terms of the typical mechanical characteristics of the components subjected to the method according to the invention to start from castings of spheroidal cast iron which have a ferrite percentage of more than 80%.

In greater detail, it has been found that it is particularly convenient to perform such thermal treatment for isothermal hardening in a bath of molten salts.

Advantageously, the temperature preferably used to perform isothermal hardening ranges from 350° C. to 390° C.

The temperature at which the mechanical components are kept, as mentioned, during the step for partial austenitizing ranges from the temperature referenced technically as $A_{c1}$, above which the structure of the cast iron starts to convert to austenite, to the temperature referenced technically as $A_{c3}$, or temperature of complete austenitizing; in practice, by bringing the part above the temperature referenced technically as $A_{c3}$ one would have a complete transformation of the structure into austenite. By instead keeping, as mentioned, the component at an intermediate temperature between $A_{c3}$ and $A_{c1}$, not all the structure becomes austenite but part of the ferrite remains as it is (proeutectoid ferrite).

Figure 7:
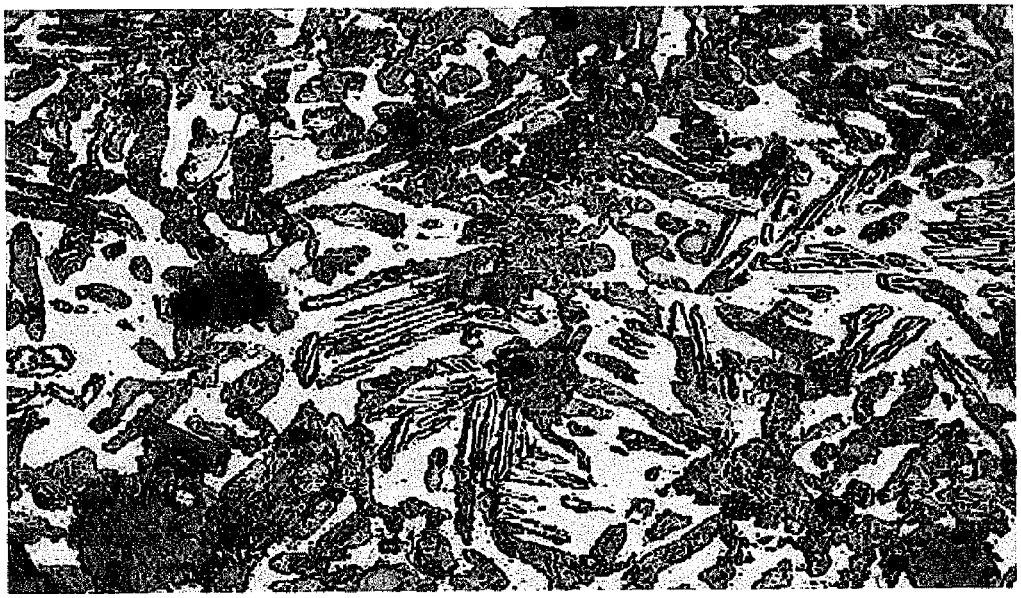
FIG. 7 is a photographic enlargement (with a magnification factor of 500) of a region of the bar shown in FIG. 6.

Moreover, it has been observed, as shown in the photograph taken with a 500× optical microscope shown in FIG. 7, that the resulting structure has islands which have an ausferritic structure.

The selection of the temperature at which the partial austenitizing is to be performed depends substantially on the amount of austenite that one wishes to obtain at the end of the period of retention at such temperature. It has been found that it is advantageous to maintain the components at a partial austenitizing temperature which allows conversion to austenite in a percentage ranging from 30% to 70% of the structure; this situation can be obtained by selecting a temperature which lies approximately halfway along the interval comprised between $A_{c3}$ and $A_{c1}$.

This can be achieved by selecting a temperature of more than 780° C. and lower than 840° C. and advantageously, depending on the content of carbon and silicon, ranging from 800 to 820° C.

Such temperatures are indications for cast irons which have a carbon content of approximately 3.50% and a silicon content of approximately 2.60%, but of course they may vary according to the percentages of such elements in the casting to be subjected to the thermal treatment.

In order to obtain a predominantly austenitic structure, it has been found experimentally that depending on the dimensions of the mechanical component the retention time of the mechanical component at the austenitizing temperature (a temperature which is intermediate between $A_{c3}$ and $A_{c1}$) ranges from 90 minutes to 210 minutes, preferably from 120 to 180 minutes.

The cast iron with a predominantly ferritic structure with which the initial casting is made can of course contain manganese in a percentage of less than 0.15% and/or copper in a percentage of less than 0.15% and/or nickel in a percentage of less than 0.15% and/or molybdenum in a percentage of less than 0.15%.

EXAMPLE 1

A bracket was cast which weighed approximately 70 kg and was made of cast iron having a predominantly ferritic matrix (ferrite in a percentage of more than 50%) with a carbon percentage of 3.55% and a silicon percentage of 2.60%.

The component was brought to a temperature for partial austenitizing (intermediate between $A_{c3}$ and $A_{c1}$) of 815° C. and was kept at this temperature for 150 minutes.

An isothermal hardening treatment in a salt bath at 370° C. was then performed.

The finished part was found to have an average hardness of approximately 255-265 HB, while the average mechanical characteristics in regions with a thermal modulus of 2.7 and 1.3 respectively are summarized in table 1.

TABLE 1

| | Rm (MPa) | Rp02 (MPa) | A5 |
|---|---|---|---|
| Region with modulus 2.7 | 720 | 500 | 7.5 |
| Region with modulus 1.3 | 820 | 550 | 8.5 |

Figure 1:
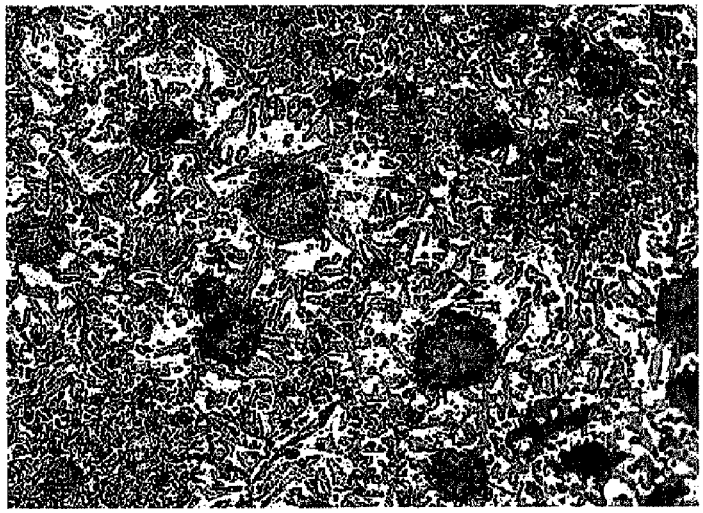
FIGS. 1 and 2 are photographic enlargements, made with an optical microscope, of two regions of a supporting bracket which weighs approximately 70 kg: the photograph of FIG. 1 refers to a region having a thermal modulus (volume/cooling surface ratio) of 2.7; the photograph of FIG. 2 relates instead to a region which has a thermal modulus of 1.3.
Figure 2:
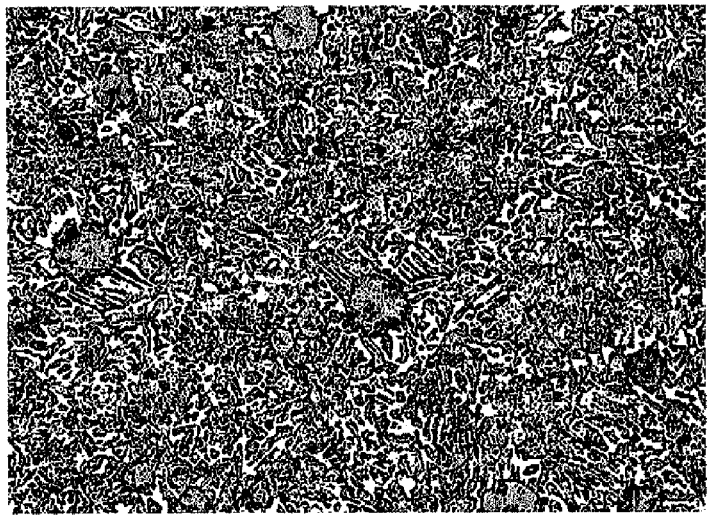

FIGS. 1 and 2 are photographs (with 200× magnification) taken with an optical microscope and show the metallographic structure of the part in the regions having a thermal modulus respectively of 2.7 and 1.3.

EXAMPLE 2

A spider was cast which weighed 68 kg and was made of cast iron having a predominantly ferritic matrix (ferrite percentage of more than 70%) with a carbon percentage of 3.55% and a silicon percentage of 2.60%.

The component was brought to a temperature for partial austenitizing (intermediate between $A_{c3}$ and $A_{c1}$) of 820° C. for 140 minutes.

An isothermal hardening treatment in a salt bath at 375° C. was then performed.

The finished part was found to have an average hardness of approximately 250-260 HB, while the average mechanical characteristics in regions with a thermal modulus of 2.4 and 1.35 respectively are summarized in table 2.

TABLE 2

| | Rm (MPa) | Rp02 (MPa) | A5 |
|---|---|---|---|
| Region with modulus 2.4 | 700 | 450 | 5.5 |
| Region with modulus 1.35 | 800 | 480 | 8.0 |

Figure 3:
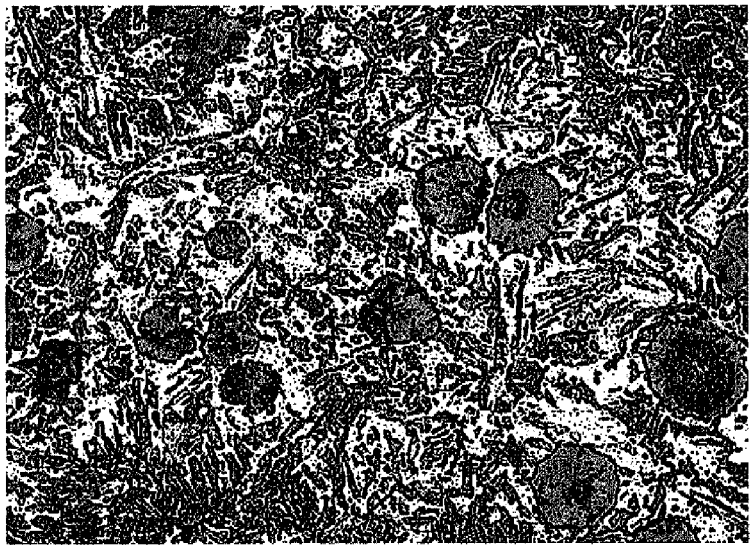
FIGS. 3 and 4 are photographic enlargements, made with an optical microscope, of two regions of a spider which weighs approximately 68 kg: the photograph of FIG. 3 refers to a region which has a thermal modulus of 2.4 and the photograph of FIG. 4 relates to a region which has a thermal modulus of 1.35.
Figure 4:
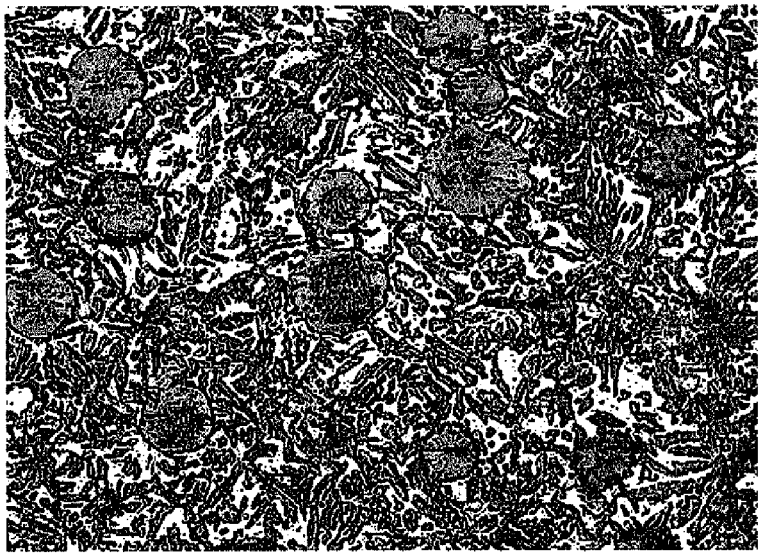

FIGS. 3 and 4 further show two photographs (with 200× magnification) taken with an optical microscope, illustrating the metallographic structure of the part in the regions with a thermal modulus of 2.4 and 1.35 respectively.

EXAMPLE 3

A spider was cast which weighed approximately 76 kg and was made of cast iron having a predominantly ferritic matrix (ferrite percentage of more than 80%) with a carbon percentage of 3.55% and a silicon percentage of 2.60%.

The component was brought to an austenitizing temperature (intermediate between $A_{c3}$ and $A_{c1}$) of 830° C. for 160 minutes.

An isothermal hardening treatment in a salt bath at 380° C. was then performed.

The finished part was found to have an average hardness of approximately 240-250 HB, while the average mechanical characteristics in a region with a thermal modulus of 1.2 are summarized in table 3.

TABLE 3

| | Rm (MPa) | Rp02 (MPa) | A5 |
|---|---|---|---|
| Region with modulus 1.2 | 730 | 440 | 8.5 |

Figure 5:
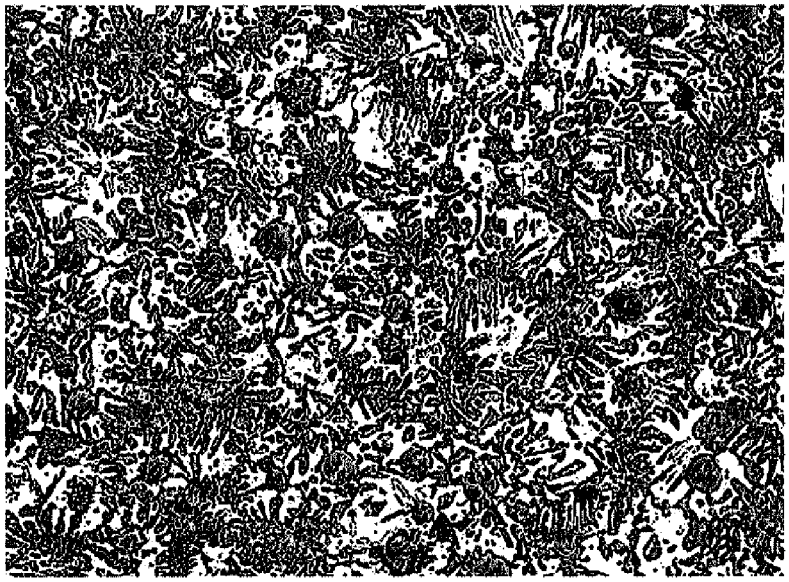
FIG. 5 is a photographic enlargement, made with an optical microscope, of a region of a second spider which weighs approximately 76 kg at a region having a thermal modulus of 1.2.

FIG. 5 shows a photograph taken with an optical microscope (with 200× magnification), illustrating the metallographic structure of the part in the region with a thermal modulus of 1.2.

EXAMPLE 4

Figure 6:
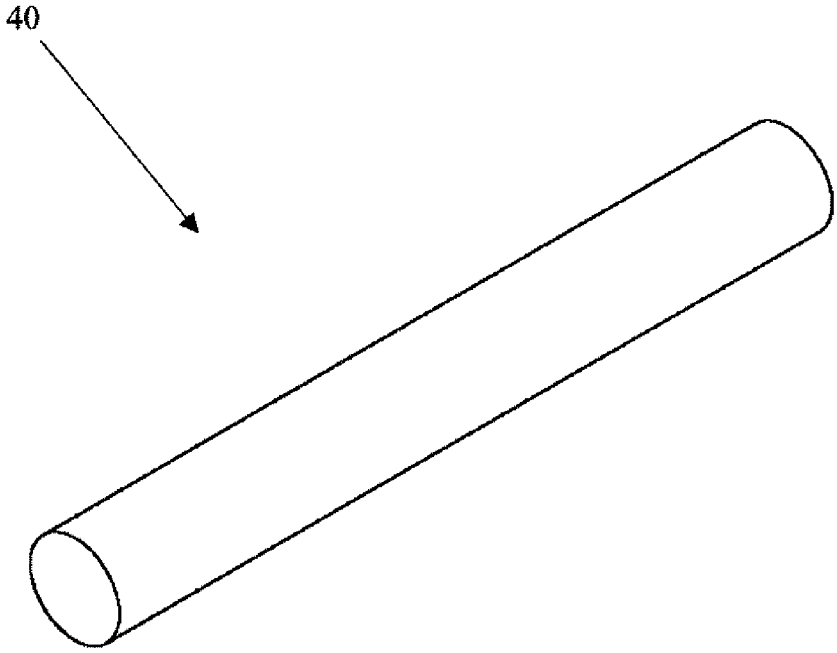
FIG. 6 is a perspective view of a cylindrical bar.

Test pieces were cast which had a diameter of 25 mm and a length of 200 mm; one of these test pieces is shown in FIG. 6 and designated by the reference numeral 40; the test pieces were made of cast iron having a predominantly ferritic matrix with a carbon percentage of 3.65% and a silicon percentage of 2.65%.

The component 40 was brought to an (austenitizing) temperature of 810° C. for 160 minutes.

An isothermal hardening treatment in a salt bath at 375° C. was then performed.

The finished part was found to have an average hardness of approximately 260-270 HB, while the average mechanical characteristics in the region 40*a* are summarized in table 4.

TABLE 4

| | Rm (MPa) | Rp02 (MPa) | A5 |
|---|---|---|---|
| Region 40a | 890 | 580 | 8.5 |

FIG. 7 shows a photograph taken with an optical microscope (with 200× magnification), illustrating the metallographic structure of the test piece in the region designated by the reference numeral 40*a*.

Notchless test pieces for rotary flexural fatigue tests with a diameter of 6.5 mm were subsequently obtained from these test pieces having a diameter of 25 mm and were found to have a fatigue limit of 368 MPa.

The present invention of course also relates to mechanical components made of spheroidal cast iron having a substantially ferritic-pearlitic structure with islands having an ausferritic structure.

All the characteristics of the invention indicated above as advantageous, convenient or the like may also be omitted or be replaced with equivalents.

The invention thus conceived is susceptible of numerous modifications and variations, all of which are within the scope of the appended claims.

Thus, for example, it has been observed that the type of cast iron can be obtained by providing a hardening and tempering treatment, performing the latter at a temperature which is close to, or higher than, $A_{c1}$.

In practice, it has been found that the invention has achieved the intended aim and objects in all the embodiments.

In practice, the dimensions may be any according to requirements.

All the details may further be replaced with other technically equivalent elements.

The disclosures in Italian Patent Application No. VR2006A000111 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A method for manufacturing mechanical components made of spheroidal cast iron, comprising the following steps:

providing a casting of a mechanical component made of cast iron having a percentage of ferrite higher than 20% and having a carbon content ranging from 2.5% to 4.0% and a silicon content ranging from 2.0% to 3.5%;

bringing said cast iron casting to a temperature suitable for partial austenitizing, which is higher than the lower austenitizing temperature ($A_{c1}$) and lower than the upper austenitizing temperature ($A_{c3}$), for a time required to obtain a structure comprising ferrite and austenite; and performing a thermal treatment of the structure comprising ferrite and austenite for isothermal hardening at a temperature ranging from 250° C. to 400° C. so as to obtain a matrix which has an at least partially pearlitic-ferritic or perferritic structure.

2. The method according to claim 1, wherein said thermal treatment for isothermal hardening is performed in a bath of molten salts.

3. The method according to claim 1, wherein said casting of a mechanical component made of cast iron having the percentage of the ferrite higher than 50%.

4. The method according to claim 1, wherein said casting of a mechanical component made of cast iron having the percentage of the ferrite higher than 80%.

5. The method according to claim 1, wherein said casting has, at the end of the step for holding at the austenitizing temperature ranging from $A_{c1}$ to $A_{c3}$, a percentage of austenite ranging from 30% to 70%.

6. The method according to claim 1, wherein said isothermal hardening is performed at a temperature ranging from 350° C. to 390° C.

7. The method according to claim 1, wherein said austenitizing temperature ranges from 780° C. to 840° C.

8. The method according to claim 1, wherein the time for which said casting of a mechanical component made of cast iron is held at an austenitizing temperature ranging from $A_{c1}$ to $A_{c3}$ ranges from 90 to 210 minutes.

9. The method according to claim 1, wherein said matrix having the at least partially pearlitic-ferritic or perferritic structure has islands with an ausferritic structure.

10. The method according to claim 1, wherein said casting has, at the end of the step for holding at the austenitizing temperature ranging from $A_{c1}$ to $A_{c3}$, a percentage of austenite substantially equal to 50%.

11. The method according to claim 1, wherein said austenitizing temperature ranges from 800° C. to 820° C.

12. The method according to claim 1, wherein the time for which said casting of a mechanical component made of cast iron is held at an austenitizing temperature ranging from $A_{c1}$ to $A_{c3}$ ranges from 120 to 180 minutes.

* * * * *